United States Patent [19]

Yant et al.

[11] Patent Number: 4,941,752

[45] Date of Patent: Jul. 17, 1990

[54] MIXING EQUIPMENT AND METHODS

[75] Inventors: Robert E. Yant, Medina; Mark E. Piechuta, Akron, both of Ohio

[73] Assignee: Quantum Technologies, Inc., Twinsburg, Ohio

[21] Appl. No.: 185,456

[22] Filed: Apr. 25, 1988

[51] Int. Cl.[5] ..... B01F 7/04; B01F 7/18; B01F 15/00

[52] U.S. Cl. ..... 366/307; 366/314; 366/325; 366/347; 366/605

[58] Field of Search ..... 366/279, 302, 306, 307, 366/244–253, 305, 304, 303, 228, 229, 605; 241/172, 179, 182; 68/132, 134; 422/205, 135, 228; 261/84

[56] References Cited

U.S. PATENT DOCUMENTS

| | | | |
|---|---|---|---|
| 26,109 | 11/1859 | Jebb | 366/307 |
| 195,803 | 10/1877 | Clous | 366/307 X |
| 360,485 | 4/1887 | Smith | 366/307 |
| 573,400 | 12/1896 | Force | 366/307 |
| 716,566 | 12/1902 | Meeker | 366/307 |
| 2,082,796 | 6/1937 | Gaertner | 259/107 |
| 2,136,936 | 11/1938 | Cohen | 366/302 |
| 2,159,856 | 5/1939 | MacLean | 259/107 |
| 2,757,909 | 8/1956 | Wayne | 259/107 |
| 3,712,592 | 1/1973 | Heatcoat | 366/307 |
| 4,244,531 | 1/1981 | Szegvari | 241/172 |
| 4,339,206 | 7/1982 | Ahs | 366/307 |
| 4,614,439 | 9/1986 | Brunt et al. | 366/307 X |

FOREIGN PATENT DOCUMENTS

| | | | |
|---|---|---|---|
| 30725 | 6/1904 | Switzerland | 366/247 |

OTHER PUBLICATIONS

Chemical Engineering Progress, 44, No. 3, 189–194 (1948)—article by D. E. Mack and A. E. Kroll.

Chemical Engineering Progress, 44, No. 5, 341–346 (1948)—article by E. J. Lyons.

July 1986, Tappi Journal, pp. 84–88, article by D. W. Reeve and P. F. Earl.

*Primary Examiner*—Harvey C. Hornsby
*Assistant Examiner*—Joseph S. Machuga
*Attorney, Agent, or Firm*—Arthur S. Collins

[57] ABSTRACT

Improved mixing equipment of the wall-baffled, cylindrical, mixing-vessel type is provided. The novel baffles employed have a uniform cross-sectional form corresponding generally to a small geometric segment of a circle, the radius of which circle is substantially equal to that of the inner wall of said mixing vessel. A plurality (e.g., 2 to 4) of such baffles mounted at uniformly spaced locations around the periphery of said inner wall are employed together with a concentrically located, multi-bladed impeller capable of providing good axial and radial mixing within said vessel.

The subject mixing equipment can deliver outstanding performance in terms of speed and completeness of mixing, as well as economy in power consumption and peak power requirements. Results are especially noteworthy when the equipment is used to mix chemical reagents (gaseous or liquid) with thick, non-Newtonian suspensions of solids and liquids; e.g., wet wood pulps and similar compositions containing fine, fibrous solid matter.

20 Claims, 2 Drawing Sheets

MIXING EQUIPMENT AND METHODS

This invention is directed to improved apparatus especially suited for mixing solids/liquids suspensions and to methods of operating same to realize particularly advantageous mixing results. A key feature of said apparatus is a system of stationary baffles which extend axially along the lateral wall of the mixing chamber. In combination with a suitable, cooperating agitator, the installation of our novel system of stationary baffles in place of the normal stationary baffles previously used in cylindrically shaped mixer pots results in modified apparatus in which most solids/liquids suspension systems can be thoroughly mixed relatively quickly with reduced total power input. In addition, savings in peak power drawn and overall mixing cost can also be realized in many cases.

Furthermore, mixing equipment embodying our invention has shown exceptionally fast, efficient performance in mixing liquids and/or gases with finely divided fibrous solids, such as wood pulp, while avoiding substantial deterioration in the integrity of such solids.

BACKGROUND OF THE INVENTION

A wide variety of mechanical apparatuses has been developed for use in the mixing of various solids/liquids suspension systems, such as paints and the like. The basic structure employed in the majority of such mixers can generically be described as some form of stirred vessel; i.e., a tank or mixing chamber having one or more mechanically driven agitators or impellers mounted therein. Said agitators can vary widely in type, location and method of mounting in a particular mixing chamber.

When the impeller is not equipped with its own surrounding shroud or stator elements, tank wall baffles are sometimes employed to alter flow patterns therein and promote better mixing. Such baffles are usually uniform, elongated, rigid strips mounted longitudinally in the mixing chamber in a generally axial direction along or near the lateral wall thereof. In the standard arrangement for "fully baffled" cylindrical chambers equipped with concentrically mounted agitators, about four such baffles located at regular (i.e., 90°) intervals around the chamber wall are most often recommended.

Such baffles are usually solid parallelepiped strips (e.g., of metal plate) and are usually oriented so that a small axis thereof is aligned with radii of said chamber. However, it is also known to use slanted mounting of such parallelepiped strip baffles, so that an axis thereof is oriented at an angle to the axis and/or the radii of such chamber. Typical prior art teachings regarding baffle arrangements for mixing devices are found in the following publications:

(1) Chemical Engineering Progress 44, p. 189 et seq., (1948) - article by D. E. Mack & A. E. Kroll;

(2) Chemical Engineering Progress 44, p. 341 et seq., (1948) - article by E. J. Lyons; and (3) U.S. Pat. No. 2,159,856 - MacLean (1939)

(4) U.S. Pat. No. 2,082,796 - Gaertner (1937)

SUMMARY OF THE INVENTION

A primary objective of this invention is the provision of improved apparatus for accomplishing fast and thorough mixing in solids/liquids suspensions. Another objective is to devise compact mixing apparatus which is economical, efficient and dependable even when used to mix thick suspensions of finely divided solid material.

A secondary, more specialized objective is the provision of mixing equipment which is suitable for rapidly mixing various liquids and/or gases with finely divided fibrous solids, such as wood pulps, without substantially damaging the fiber strength or particle integrity thereof. A further objective is to devise improved methods of handling, processing and treating such a solids/liquids suspension in such equipment so as to effect chemical changes therein; e.g., bleaching and/or purification thereof. Still other objectives and advantages of our invention will be obvious or become more clear from the detailed disclosures, specific embodiments and operating methods described and claimed hereinafter.

The improved mixing device of this invention basically comprises a cylindrical mixing chamber having a length-to-diameter ratio of at least about 0.5 to 1 and equipped with a multibladed agitator disposed for concentric rotation therein via a suitable drive shaft and wherein a plurality of equally spaced, elongated baffles, the cross-sectional form of which in geometric terms is a small segment of a circle substantially equal to said chamber in radius, are arranged in axial alignment therein with their rounded surfaces against the chamber wall. Preferably, the length of the baffles is substantially more than half that of said cylindrical mixing chamber, and the axial dimension of said multibladed agitator is at least about half the length of the individual baffles. The maximum radial dimension (or thickness) of said baffles is likewise an important consideration and can conveniently be specified in relation to the size of the mixing chamber. Thus, said maximum baffle thickness should measure between about one-fortieth and about one-tenth of the inside diameter of said chamber, corresponding to subtended angle sizes of between about 37° and 74°. Preferably, said baffles have subtended angles between about 42° and about 65°, corresponding to a maximum thickness between about one-thirtieth and about one-twelfth of said diameter. Ideally, the sum total of said subtended angles is between about 90° and about 180°.

The improved mixing equipment of this invention can be used with advantage in mixing a wide variety of solids/liquids suspension systems, including simple, relatively dilute and fluid suspensions approaching ideal Newtonian viscosity behavior, as well as complex, relatively concentrated slurries which usually exhibit anomalous viscosity characteristics. Furthermore, in spite of the widely different types of impellers that are favored for the various services represented by this large spectrum of solids/liquids suspensions, excellent results are obtained from almost all types that are concentrically rotated in a cylindrical mixing chamber equipped with two to four individual wall baffles of our novel design. The economically important reduction in power required to operate a given agitator, which is achieved by substituting the subject baffles for conventional ones, is particularly notable when the agitator is started up under load and/or when the solids/liquids suspension system is thixotropic.

Finely divided fibrous solids, such as pulped woody fibers, are especially likely to form highly thixotropic suspensions while undergoing purification and bleaching treatments; e.g., in the production of paper. Since the energy inputs required to mix such materials with the liquid and/or gaseous chemical reactants involved are unusually high, special additional benefits accrue from using properly enclosed mixing equipment of this invention to effect such treatments. Thus, the thorough mixing needed to initiate uniform chemical reaction within the pulped fiber suspension can be quickly accomplished in our apparatus, using less power and with minimal physical damage to the fibers from the mechanical action generated by the impeller.

DETAILED DESCRIPTION OF THE INVENTION

Figure 1:
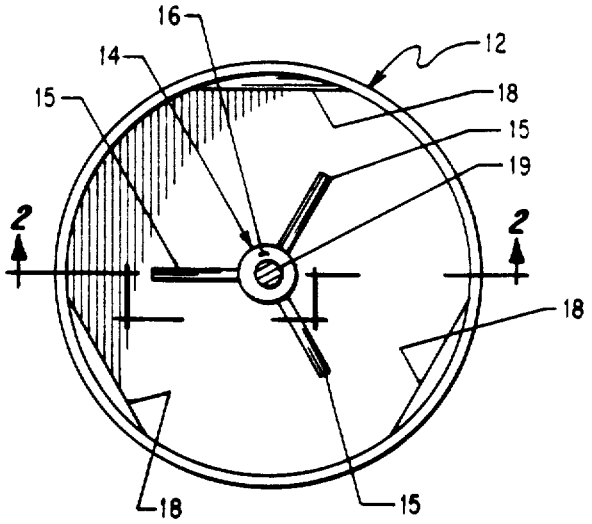
FIG. 1 is a top view of a batch-type mixing apparatus exemplifying the present invention and having a three-bladed impeller operated by a top-entering drive shaft.
Figure 2:
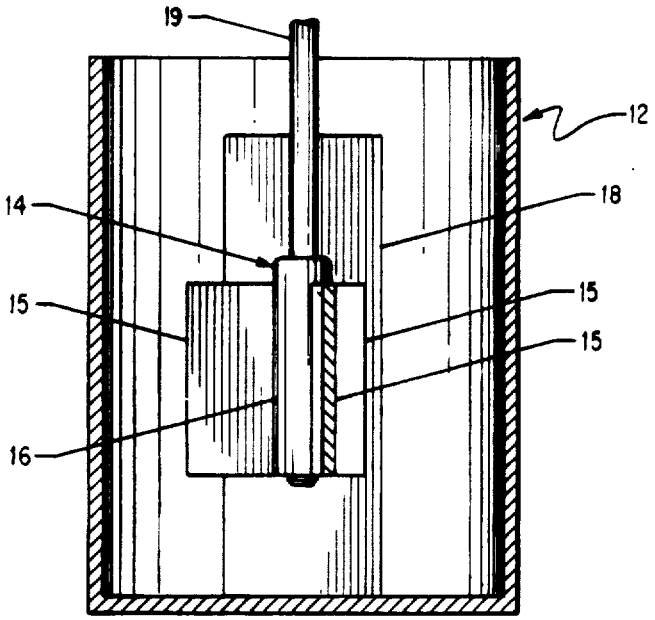
FIG. 2 is a cross-sectional side view of the same apparatus taken through line 2—2 of FIG. 1.

A simple batch mixer is shown in FIGS. 1 and 2. In this apparatus, the mixer housing is a right circular cylindrical tank 12 open at the top and otherwise essentially closed except for any suitable outlets or drainage fittings desired (none shown). Three-bladed impeller 14 is mounted in the center of tank 12 by means of top-entering drive shaft 19, which is coaxially aligned therein. The blades 15 are of flat rectangular shape and run vertically along the hub 16 of impeller 14 at equidistant positions around its periphery. To promote better axial circulation, such blades can also be pitched at a small angle (e.g., about 5° to 25°). The drive train (not shown) for drive shaft 19 can be suitably arranged above tank 12 in known fashion. Three vertically extending baffles 18 are mounted at equal intervals on the inside of the lateral wall of tank 12. These baffles extend from almost the bottom of said lateral wall up to about the top level expected to be reached by the solids/liquids system to be processed. The central subtended angle of each of said circular-segment-shaped baffles 18 on tank 12 is about 45°, which means that the maximum thickness of said baffles is about one twenty-sixth of the inside diameter of tank 12.

Figure 3:
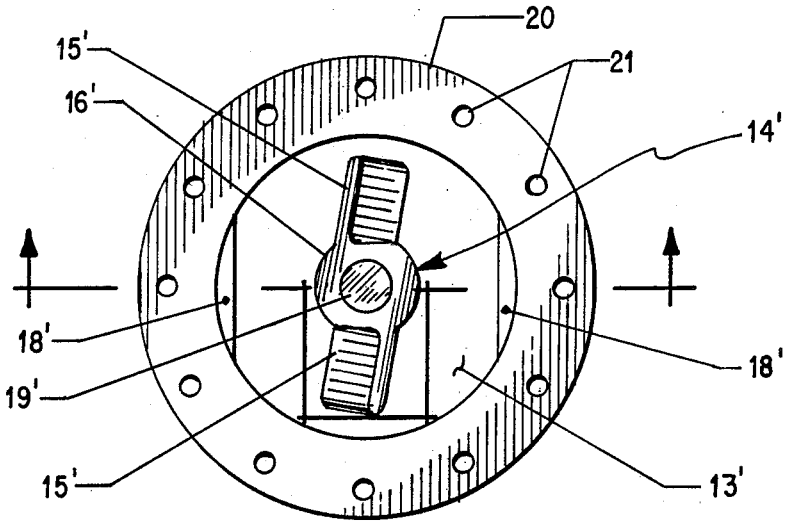
FIG. 3 is a top view (taken without its removable cover) of another batch-type mixer of heavier duty construction but still in accordance with this invention and having a double-blade agitator operated by a bottom-entering drive shaft.
Figure 4B:
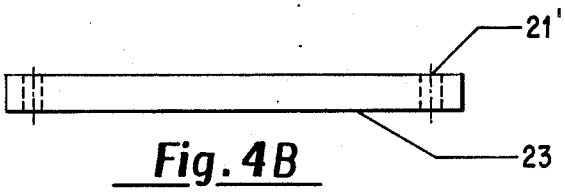
FIG. 4B is a schematic depiction of a removable cover suitable for attachment to the mixer of FIGS. 3 and 4A.
Figure 4A:
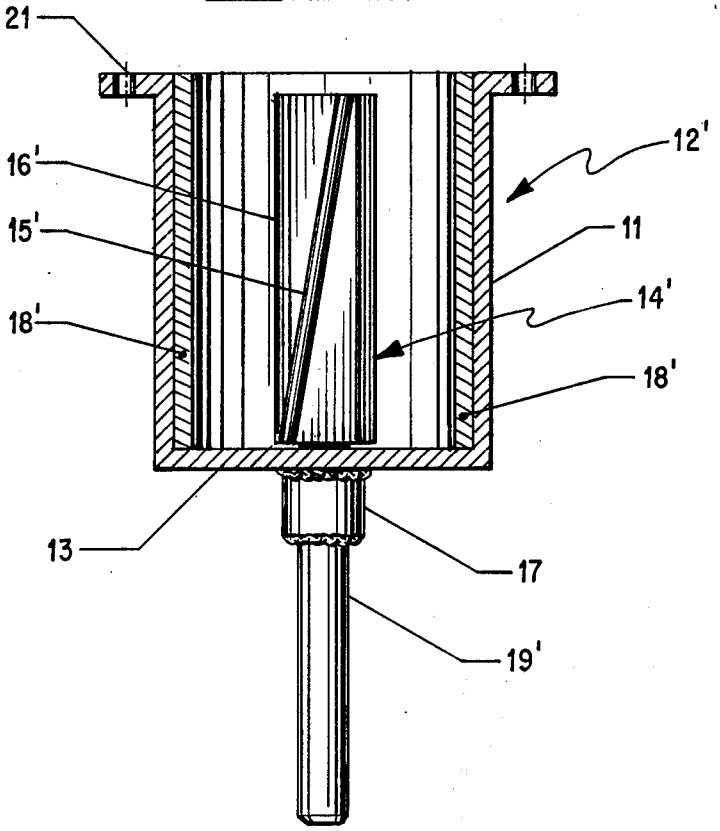
FIG. 4A is a side view of the mixer of FIG. 3, taken along cross-section line 4—4 thereof.

FIGS. 3, 4A and 4B exemplify a more compact and heavier-duty, batch-style mixer, designed for pressurized service. In this embodiment, the mixing pot 12' has a height not substantially greater than its internal diameter and a thick cylindrical side wall 11 joined continuously at the bottom to an equally strong floor 13. Likewise, the side wall 11 is provided at the top with an integral flange ring 20, having suitable bolt holes 21, via which matched removable cover 23 can be attached via corresponding bolt holes 21'. Optionally, side wall 11 can also be provided with means (not shown) for supplying heat thereto; e.g., in such known fashions as via electrical heating bands or an annular jacket for hot fluid.

Mixing pot 12' is also provided with a heavy-duty impeller 14', mounted on drive shaft 19', which extends coaxially into pot 12' through an opening in floor 13, encompassed by sealing gland fitting 17. Impeller 14' is substantially coextensive with the full height of side wall 11 and comprises central hub member 16', in which are rooted a pair of generally rectangular-shaped blades 15' of substantially equal size. Said blades 15' are pitched at a slight angle to the vertical axis (e.g., about 10°) and traverse substantially the full height of impeller hub member 16' in suitably opposed locations thereon. A drive train for shaft 19 is not shown but can be located below floor 13 in any suitable and convenient arrangement desired.

In mixing pot 12', two solid wall baffles 18' are mounted on side wall 11 in substantially opposed positions thereon. Each of said baffles 18' extends vertically along substantially the full height of side wall 11 and has a cross-sectional shape of a circular segment with a subtended central angle of about 55°, giving a maximum thickness of baffles 18' (i.e., at the center line thereof) of about one-seventeenth of the inside diameter of mixing pot 12'.

Because of its completely closable and pressure-sealable design, the heavy-duty mixer of FIGS. 3, 4A and 4B is well-suited for intensive mixing of a wide variety of thick suspensions or other viscous systems, such as wood pulps or similar fluid suspensions of fine-solids in liquids and/or gases. Indeed, when constructed of suitable corrosion-resistant materials, such embodiments of the present invention can serve admirably as highly versatile, well-mixed chemical reactors. For example, they are eminently capable of serving as mixer/reactors for carrying out various purification treatments of fine solids, including the bleaching and/or delignification of cellulosic fibers. Of course, for such services, various fittings (not shown in FIGS. 3, 4A and 4B) can be provided on mixing pot 12' for use in introducing gaseous or liquid reactants and/or for attaching measuring or sampling devices or discharge lines, etc. For example, such fittings could be located at any clear location in the exterior of mixing pot 12', including any or all of side wall 11, floor 13, or removable cover 23 for top flange 20.

Figure 6A:
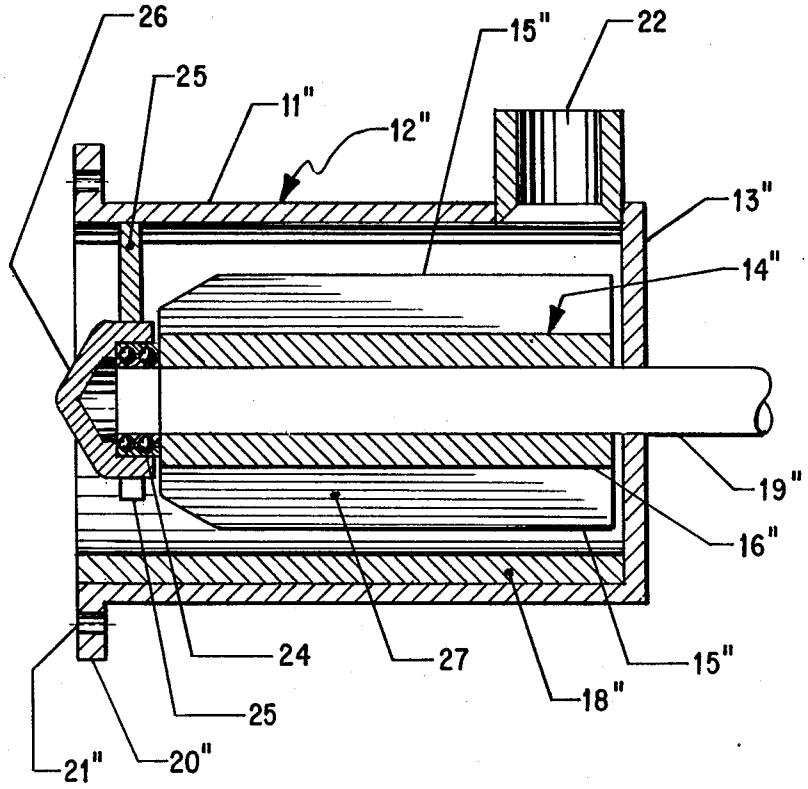
FIG. 6A is a side view of the apparatus depicted in FIG. 5, taken along cross-section line 6—6 thereof.
Figure 6B:
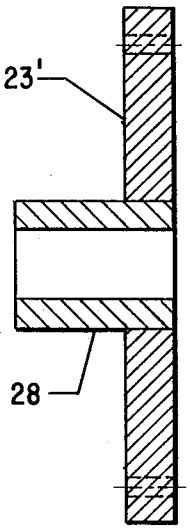
FIG. 6B is a cross-sectional representation of a removable closure piece for said open end of the mixing apparatus of FIGS. 5 and 6A.
Figure 5:
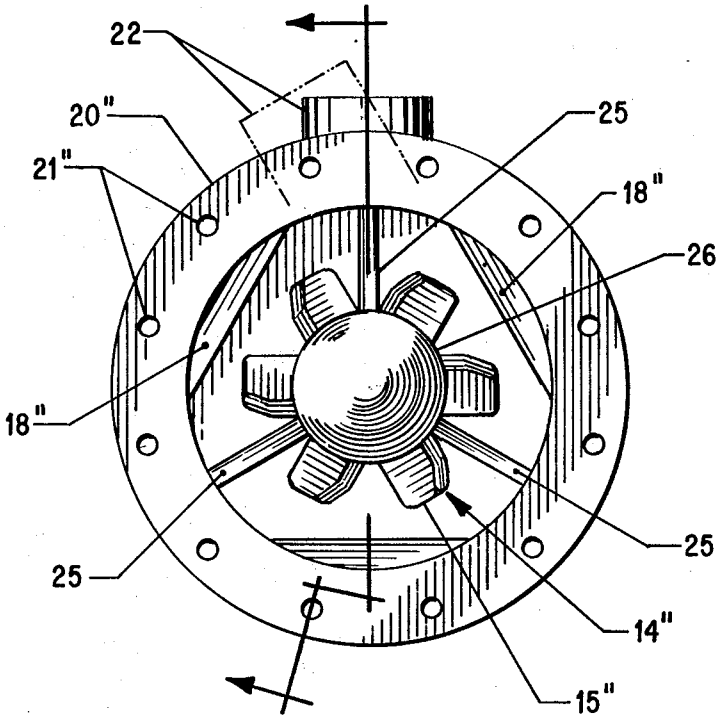
FIG. 5 is an end view taken from the open, flanged end of a continuous mixing apparatus embodying the present invention and having a six-bladed agitator operated by a drive shaft which enters through the opposite, closed end thereof.

FIGS. 5, 6A and 6B depict a comparable, heavy-duty mixer of modified design, adapted for continuous operation. The cylindrical mixing chamber 12'' of this apparatus is preferably oriented with its axis at least roughly horizontal. One end of thick sidewall 11'' of chamber 12'' is joined in pressure tight relationship to an equally strong end plate 13''. The opposite end of chamber 12'' is essentially open but is integrally provided with sturdy outer flange ring 20'', having suitable bolt holes 21'' (or equivalent fastening means) for removably attaching a tight closure piece 23'. Said closure piece 23', in turn, is equipped with a large central opening connected to an access fitting 28, adapted for continuously introducing wet suspensions of fine solid matter to be treated. A discharge fitting 22 of adequate size is joined tightly to sidewall 11'' in close proximity to end plate 13'' to allow the treated suspension to be steadily removed from chamber 12''. The length of chamber 12'' is preferably substantially greater than its inner diameter (e.g., about 1.5 times said diameter).

Drive shaft 19'' extends coaxially into chamber 12'' through a sealable opening in end plate 13'' via suitable seal fitting thereon (not shown here, but similar to 17 in FIG. 4A) and terminates near the opposite, open end of 12'' in a support bearing 24 contained in bearing housing 26, which is rigidly held in place by three struts 25, the opposite ends of which are attached to wall 11''. Bearing housing 26 has a closed face, preferably shaped like a nose cone pointing concentrically at the central opening in the closure piece 23' for flange ring 20''. The portion of shaft 19'' between bearing housing 26 and end plate 13'' is engaged with surrounding hub member 16'' of heavy-duty agitator 14''. Hub member 16'' has a roughly hexagonal exterior, into the flat sides 23 of which are rooted six matching, equally spaced blades 15''. Each of said blades is pitched at a clockwise progressing angle of about 6° (moving from the end near bearing 24) and extends along substantially the full length of hub member 16''. Said blades 15'' are substantially rectangular in shape, except for short tapered sections 27 at the ends near bearing 24. The angular pitch of blades 15'' assists in attaining steady-state transport of material through chamber 12'' when agitator 14'' is rotated counter-clockwise.

Three full wall baffles 18'', each of which has a cross-sectional shape of a circular segment with a subtended angle of about 60°, are mounted against sidewall 11'' of cylinder 12'' at equally spaced apart, axially aligned positions. The maximum thickness of said baffles 18'' (i.e., at the midline thereof) is about one-fifteenth of the inside diameter of chamber 12''.

The solid line representations of FIGS. 5 and 6A show discharge fitting 22 positioned so that its axis is aligned radially to chamber 12''. Such positioning satisfactorily discharges the mixed product, regardless of the type of agitator or its direction of rotation. However, an alternative positioning is represented by the dotted outline 22' in FIG. 5 (where the discharge fittings axis is approximately in parallel alignment with the flat surface of one of the nearby baffles 18''). Such an alternative position could assist in obtaining smoother discharge when agitator 14'' is rotated in a counter-clockwise direction. Conversely, when agitator 14'' is rotated clockwise, the analogous alternative (not depicted) of aligning fitting 22 with the flat surface of the other nearby baffle 18'' should prove advantageous.

As with the batch apparatus of FIGS. 3, 4A and 4B, various fluid chemical reagents (including gases and/or liquids) can be introduced into chamber 12'' of FIGS. 5 and 6A. Appropriate inlet fittings for feeding such reagents are not specifically depicted but could be located at various points on sidewall 11''; e.g., in between solid wall baffles 18'', as well as in the closure member 23' for flange ring 20''. Generally speaking, such inlet fittings that are intended for feeding gaseous reagents are preferably located at least somewhat below midlevel of chamber 12''.

Comparing the light-duty mixer depicted in FIGS. 1 and 2 with the compact, heavy-duty designs of the other drawings, some major differences are apparent in the dimensions of the impellers relative to their respective mixing chambers. Thus, the height of impeller 14 is only about half of the usable height of open tank 12, whereas the length of impeller 14' is almost coextensive with chamber 12', and agitator 14'' is only about 15 percent shorter than chamber 12''. Likewise, the radius of impeller 14 is only slightly over half that of tank 12, whereas impellers 14' and 14'' are about three-fourths as large in radius as their respective mixing chambers 12' and 12''. Accordingly, the higher-intensity mixers characteristically tend to have relatively narrow clearance gaps between the blade tips on the impeller and the thickest portion of the wall baffles; e.g., typically only about one-fifth to about one-tenth of the radius of the mixing chamber, compared to about one-half to about one-third for low-intensity mixers.

The novel baffle arrangements of this invention deliver significant economic advantages when substituted for the stationary rib baffles of standard design, regardless of the gap clearances, intensity levels, etc., employed. Generally, worthwhile savings (e.g., about 5 to 25 percent) in mixing time and/or power requirements to accomplish a given mixing job are realized, with the larger savings being more likely when viscous and/or non-Newtonian suspensions are processed via high-intensity agitation. For purposes of the present description, the region referred to as "high-intensity" agitation is considered to cover that achieved by operation of a well-designed impeller at tip speeds above about 20 feet per second, and typically at tip speeds of between about 20 and about 100 feet per second.

Various methods can be used for fabricating the baffle elements for this invention, with the preferred technique being largely determined by the material of construction and the quantity of individual elements being produced. Thus, for a limited number of units, the individual elements can simply be sliced off of the outside of a cylinder having an outside diameter equal to the inside diameter of the mixing chamber to be used. For larger quantities, such mass production methods as extruding stock in the desired cross-sectional shape or casting molten material in molds of the desired shape are attractive alternatives.

Based upon extensive studies of mixing, chemically treating and bleaching wood pulps or other wet suspensions of fibrous solids in a laboratory mixer of the same basic design as shown in FIGS. 3, 4A and 4B, we have found that even pulps having consistencies (i.e., dry solid contents) higher than 20 percent by weight can be thoroughly mixed in only a few seconds (e.g., 4 to 20 seconds) by using tip speeds in the upper part of the "high-intensity" agitation range defined herein above. Furthermore, we have been able to achieve good high-speed, substantially complete mixing of such high-consistency materials in our novel apparatus without significant concomitant changes in fiber strength or integrity of the fibrous solid particles involved. These advantages are especially important and timely in view of the current trend toward operating pulp treatments at higher and higher consistencies.

This invention has been described with respect to various specific, representative embodiments, but it will be obvious that many equivalent constructions and alterations or substitutions can be incorporated within the spirit or scope of our teachings and the definitions contained in the appended claims.

We claim:

1. In a mixing device having a mixing chamber with a cylindrical inner wall, a multibladed agitator adapted for rotation concentrically within said chamber via a suitable drive shaft and a plurality of equally spaced, elongated baffles coaxially extending along the inner wall of said chamber for the major portion of its length, the improvement which comprises each of said baffles having a uniform cross-sectional shape corresponding generally to a small geometric segment of a circle, the radius of which is substantially the same as that of the inner wall of said chamber, with the rounded, substantially cylindrical surface of each baffle fitted against the inner wall of said chamber and with the flat sides of said baffles facing inwardly.

2. An improved mixing device in accordance with claim 1, wherein the number of elongated baffles is not more than four and the circular segment defining the cross-sectional shape of said baffles has a central subtended angle of between about 37° and about 74°.

3. An improved mixing device as in claim 2, wherein the subtended angle of said circular segment is between about 42° and about 65°, and the sum total of the subtended angles of all said baffles is between about 90° and about 180°.

4. An improved mixing device as in claim 2, wherein the maximum thickness of said baffles is between about one-tenth and about one-fortieth of the inside diameter of said chamber and said blades are limited in radial dimensions so as to provide a clearance gap between their outer tips and the thickest sections of said baffles which is not substantially less than about one-tenth of the inside radius of said chamber.

5. An improved mixing device as in claim 4, wherein the maximum thickness of said baffles is between about one-twelfth and about one-thirtieth of the inside diameter of said chamber.

6. An improved mixing device as in claim 1, wherein said concentrically rotatable, multibladed agitator comprises a common hub member rotatably engaged with said drive shaft and said agitator has two to six individual blades of substantially equal size and shape rigidly mounted on said hub at comparable, equally spaced positions thereon and in the same orientation relative to the concentric axis of rotation thereof.

7. An improved mixing device as in claim 6, wherein said individual blades extend through at least a major portion of the axial distance within said device which is encompassed by said elongated baffles.

8. An improved mixing device as in claim 6, wherein three of said baffles are incorporated when the agitator has three or six blades and either two or four of said baffles are included when the agitator is either two-bladed or four-bladed.

9. An improved mixing device as in claim 6, wherein said individual blades are generally rectangular in shape and each one is mounted on said hub at the same angular pitch relative to said axis of rotation.

10. An improved mixing device as in claim 9, wherein said blades are pitched at about 5° to about 25° relative to their axis of rotation.

11. An intensive mixing device which is especially effective for mixing liquids and/or gases with finely divided solid materials including fibrous materials, such as wood pulp, with minimal physical damage thereto, comprising:

(a) a mixing chamber having a cylindrical inner said wall and an axial-length-to-internal-diameter ratio of at least about 0.5 to 1;

(b) a multibladed agitator with generally rectangular shaped blades, each of which is rigidly mounted at equally spaced positions on a common hub member which is concentrically rotatable within said mixing chamber by a suitable drive shaft engaging therewith, the dimensions of said blades being suitable to effect good axial and radial mixing with said chamber; and (c) a plurality of equally spaced, axially aligned baffles mounted on the inner side wall of said chamber, each of said baffles having a uniform cross-sectional shape corresponding to a geometric segment of a circle, the radius of which circle is substantially the same as that of the inner side wall of said chamber, and each of said baffles having a maximum thickness between about one-tenth and one-fortieth of the inside diameter of said chamber and being mounted so that the rounded, substantially cylindrical surface thereof is fitted against the inner side wall of said chamber and the flat sides of said baffles face inwardly toward said multibladed agitator.

12. An intensive mixing device as in claim 11, wherein the number of baffles is not more than four and the maximum thickness of each baffle is between about one-twelfth and about one-thirtieth of the inside diameter of said chamber.

13. An intensive mixing device as in claim 12, wherein the number of blades on the multibladed agitator is not more than six and each blade is mounted on said concentrically rotatable hub member at the same angular pitch, which is at least about 5° but not more than about 25° relative to the axis of rotation of said hub member.

14. An intensive mixing device as in claim 13, wherein said baffles extend along substantially the full length of said inner walls and said agitator blades also traverse about the same axial distance.

15. An intensive mixing device as in claim 13, wherein said agitator blades traverse substantially the entire axial length of said chamber and their radial dimension is controlled to provide a clearance gap between the thickest dimensions of said baffles (along the vertical midline) and the outer edges of said blades which is between about one-fifth and about one-tenth of the inner radius of said chamber.

16. An intensive mixing device as in claim 15, wherein three of said baffles are incorporated when the agitator has three or six blades and either two or four of said baffles are included when the agitator is either two-bladed or four-bladed.

17. An intensive mixing device as claimed in claim 16, which is designed to function as a continuous-style mixer and wherein the axis of said mixing chamber is in a substantially horizontal orientation, the cylindrical side wall of said chamber being closed at one end by an end plate having a seal fitting therein through which said drive shaft extends coaxially into said chamber and the opposite end of said cylindrical side wall being provided with a removable closure piece having an inlet fitting thereon through which finely divided solids can be introduced into said chamber, and wherein an outlet fitting suitable for discharging said solids is located in said side wall adjacent its closed end.

18. An intensive mixing device as in claim 17, wherein said baffles extend along substantially the full length of said chamber and the agitator blades transverse substantially the same axial distance except for a minor portion thereof adjacent to said end provided with said removable closure piece.

19. An intensive mixing device as in claim 15 designed to function as a batch style mixer and wherein the axis of said mixing chamber is in a substantially vertical orientation; said chamber having an open top and a closed base; and said device includes a sealed rotatable drive shaft concentrically located in said closed base and a tight-fitting, removable cover for the top of said chamber.

20. An intensive mixing device as in claim 19, wherein the axial length of said mixing chamber is not substantially greater than its internal diameter, the agitator has two blades and only two said circular segment baffles are included.

* * * * *

UNITED STATES PATENT AND TRADEMARK OFFICE
CERTIFICATE OF CORRECTION

PATENT NO. : 4,941,752

DATED : July 17, 1990

INVENTOR(S) : Yant et al.

It is certified that error appears in the above-identified patent and that said Letters Patent is hereby corrected as shown below:

The title page showing the illustrative figures should be deleted to appear as per attached title page.

The sheet of drawing consisting of figures 1 and 2 should be added as shown on the attached sheet.

First line on Sheet containing figs. 3, 4A & 4B, change "Sheet 1 of 2" to --Sheet 2 of 3--

First line on Sheet containing figs. 5, 6A & 6B, change "Sheet 2 of 2" to --Sheet 3 of 3--

Column 7, line 60, after "inner" insert --side-- delete "said".
Column 8, line 1, "with" should be --within--
Column 8, line 31, "walls" should be --wall--
Column 10, line 3, the word --of-- has been omitted between "two" and "said".

Signed and Sealed this

Twenty-fifth Day of June, 1991

*Attest:*

*Attesting Officer*

HARRY F. MANBECK, JR

*Commissioner of Patents and Trademarks*

United States Patent [19]

Yant et al.

[11] Patent Number: 4,941,752

[45] Date of Patent: Jul. 17, 1990

[54] MIXING EQUIPMENT AND METHODS

[75] Inventors: Robert E. Yant, Medina; Mark E. Plachata, Akron, both of Ohio

[73] Assignee: Quantum Technologies, Inc., Twinsburg, Ohio

[21] Appl. No.: 185,456

[22] Filed: Apr. 25, 1988

[51] Int. Cl.[5] ..... B01F 7/04; B01F 7/18; B01F 15/00

[52] U.S. Cl. ..... 366/307; 366/314; 366/325; 366/347; 366/605

[58] Field of Search ..... 366/279, 302, 306, 307, 366/244–253, 305, 304, 303, 228, 229, 605; 241/172, 179, 182; 68/132, 134; 422/205, 135, 228; 261/84

[56] References Cited

U.S. PATENT DOCUMENTS

| | | | |
|---|---|---|---|
| 26,109 | 11/1859 | Jebb | 366/307 |
| 195,803 | 10/1877 | Closs | 366/307 X |
| 360,485 | 4/1887 | Smith | 366/307 |
| 573,400 | 12/1896 | Force | 366/307 |
| 716,566 | 12/1902 | Meeker | 366/307 |
| 2,082,796 | 6/1937 | Gaertner | 259/107 |
| 2,136,936 | 11/1938 | Cohen | 366/302 |
| 2,159,856 | 5/1939 | MacLean | 259/107 |
| 2,757,909 | 8/1956 | Wayne | 259/107 |
| 3,712,592 | 1/1973 | Hentcoat | 366/307 |
| 4,244,531 | 1/1981 | Szegvari | 241/172 |
| 4,339,206 | 7/1982 | Ahn | 366/307 |
| 4,614,439 | 9/1986 | Brunt et al. | 366/307 X |

FOREIGN PATENT DOCUMENTS

| | | | |
|---|---|---|---|
| 30725 | 6/1904 | Switzerland | 366/247 |

OTHER PUBLICATIONS

Chemical Engineering Progress, 44, No. 3, 189–194 (1948)—article by D. E. Mack and A. E. Kroll.

Chemical Engineering Progress, 44, No. 5, 341–346 (1948)—article by E. J. Lyons.

July 1986, Tappi Journal, pp. 84–88, article by D. W. Reeve and P. F. Earl.

*Primary Examiner*—Harvey C. Hornsby
*Assistant Examiner*—Joseph S. Machuga
*Attorney, Agent, or Firm*—Arthur S. Collins

[57] ABSTRACT

Improved mixing equipment of the wall-baffled, cylindrical, mixing-vessel type is provided. The novel baffles employed have a uniform cross-sectional form corresponding generally to a small geometric segment of a circle, the radius of which circle is substantially equal to that of the inner wall of said mixing vessel. A plurality (e.g., 2 to 4) of such baffles mounted at uniformly spaced locations around the periphery of said inner wall are employed together with a concentrically located, multi-bladed impeller capable of providing good axial and radial mixing within said vessel.

The subject mixing equipment can deliver outstanding performance in terms of speed and completeness of mixing, as well as economy in power consumption and peak power requirements. Results are especially noteworthy when the equipment is used to mix chemical reagents (gaseous or liquid) with thick, non-Newtonian suspensions of solids and liquids; e.g., wet wood pulps and similar compositions containing fine, fibrous solid matter.

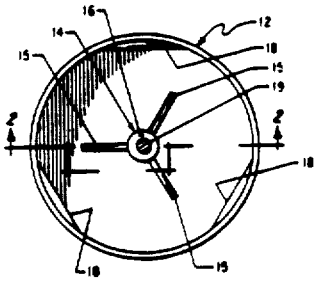

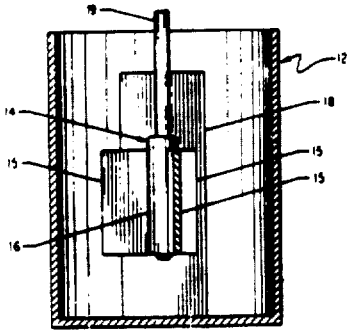

20 Claims, 3 Drawing Sheets